US009764340B2

(12) United States Patent
Zhu et al.

(10) Patent No.: US 9,764,340 B2
(45) Date of Patent: Sep. 19, 2017

(54) OSCILLATING SPRINKLER

(71) Applicant: Meridian International Co., Ltd, Songjiang, Shanghai (CN)

(72) Inventors: Lijun Zhu, Zhejiang (CN); Xuefeng Zhang, Zhejiang (CN)

(73) Assignees: Meridian International Co., Ltd, Shanghai (CN); Ningbo Meizhi Tools Co., Ltd., Ningbo (CN)

( * ) Notice: Subject to any disclaimer, the term of this patent is extended or adjusted under 35 U.S.C. 154(b) by 198 days.

(21) Appl. No.: 14/615,063

(22) Filed: Feb. 5, 2015

(65) Prior Publication Data

US 2016/0023222 A1 Jan. 28, 2016

Related U.S. Application Data

(60) Provisional application No. 62/088,004, filed on Dec. 5, 2014.

(30) Foreign Application Priority Data

Jul. 23, 2014 (CN) ..... 2014 2 0406395 U

(51) Int. Cl.
*B05B 3/16* (2006.01)
*B05B 3/04* (2006.01)

(52) U.S. Cl.
CPC ..... *B05B 3/044* (2013.01)

(58) Field of Classification Search
CPC ..... B05B 3/044
USPC ..... 239/242, 262.3, 262.4, 244, 240
See application file for complete search history.

(56) References Cited

U.S. PATENT DOCUMENTS

| | | | | |
|---|---|---|---|---|
| 3,107,056 | A | 10/1963 | Hunter | |
| 3,645,451 | A | 2/1972 | Hauser | |
| 4,005,618 | A | 2/1977 | Cohen | |
| 4,054,266 | A | 10/1977 | Guangorena | |
| 4,140,278 | A | 2/1979 | Troup | |
| 4,170,149 | A | 10/1979 | Koegel | |
| 4,220,284 | A | 9/1980 | Beiswenger et al. | |
| 4,568,024 | A * | 2/1986 | Hunter | B05B 3/0431 239/242 |
| 4,708,291 | A * | 11/1987 | Grundy | B05B 3/0431 239/242 |
| 4,718,605 | A | 1/1988 | Hunter | |
| 4,757,598 | A | 7/1988 | Redman | |
| 4,901,924 | A | 2/1990 | Kah, Jr. | |

(Continued)

*Primary Examiner* — Arthur O Hall
*Assistant Examiner* — Joel Zhou
(74) *Attorney, Agent, or Firm* — Shuttleworth & Ingersoll, PLC; Jason Sytsma

(57) ABSTRACT

The sprinkler has a drive motor with a gear assembly with a drive gear that is engaged with the sun gear of the flow adapter. A motor housing has a gear train chamber for the gear assembly, and a first chamber and a second chamber each providing for a path of flow. A switching mechanism has a valve block for alternatingly blocking and establishing the path of flow through one of the first chamber and the second chamber of the motor housing. A water wheel alternating in rotation between a clockwise direction and a counter clockwise direction based on the path of flow from one of the first chamber and the second chamber of the motor housing and engaging the gear assembly to rotate the gear assembly back and forth around the sun gear of the flow adapter and simultaneously moving the oscillating nozzle.

6 Claims, 10 Drawing Sheets

(56) References Cited

U.S. PATENT DOCUMENTS

| | | | | |
|---|---|---|---|---|
| 4,948,052 | A | 8/1990 | Hunter | |
| 4,955,542 | A * | 9/1990 | Kah, Jr. | B05B 3/0431 239/237 |
| 5,148,991 | A | 9/1992 | Kah, Jr. | |
| 5,288,023 | A | 2/1994 | Han et al. | |
| 5,330,103 | A | 7/1994 | Eckstein | |
| 5,417,370 | A | 5/1995 | Kah, Jr. | |
| 5,653,390 | A | 8/1997 | Kah, Jr. | |
| 5,685,486 | A | 11/1997 | Spenser | |
| 6,042,086 | A | 3/2000 | Roberts | |
| 6,109,545 | A | 8/2000 | Kah, Jr. | |
| 6,336,597 | B1 | 1/2002 | Kah, Jr. | |
| 6,364,217 | B1 | 4/2002 | Lockwood | |
| 7,086,609 | B2 * | 8/2006 | Wang | B05B 3/0436 239/232 |
| 7,287,712 | B2 * | 10/2007 | Kah, Jr. | B05B 3/0422 239/206 |
| 7,422,162 | B2 * | 9/2008 | Wang | B05B 3/044 239/242 |
| 7,891,641 | B1 | 2/2011 | Miller | |
| 8,469,288 | B1 | 6/2013 | Clark et al. | |
| 8,733,597 | B2 | 5/2014 | Fitzpatrick et al. | |
| 2001/0046918 | A1 | 11/2001 | Spanski | |
| 2002/0023972 | A1 | 2/2002 | Kah, Jr. | |
| 2004/0108392 | A1 | 6/2004 | Kah, Jr. | |
| 2008/0128531 | A1 | 6/2008 | Kah | |
| 2011/0108637 | A1 | 5/2011 | Kah, Jr. | |

* cited by examiner

OSCILLATING SPRINKLER

CROSS-REFERENCE TO RELATED APPLICATIONS

This application claims priority to Chinese Application No. 201420406395.0 filed Jul. 23, 2014 and to U.S. Provisional Application No. 62/088,004 filed Dec. 5, 2014, the entirety of both of which are hereby incorporated by reference herein.

This disclosure relates to sprinklers, and more particularly this disclosure relates to a gear driven oscillating sprinkler.

BACKGROUND

A great variety of lawn sprinklers have been devised and manufactured. All are intended to distribute water as uniformly as possible over a given lawn area at the rate at which the water will soak into the ground. Some are simple sprinkler manifolds with no moving parts. Some provide for a multiplicity of streams from nozzles which rotate about a vertical or horizontal axis, and many are adjustable to limit the area to be sprinkled at any given setting. The constantly moving streams are preferable in that they spread the water for a given location of the sprinkler over a larger area for optimum absorption. While sprinklers rotating about a vertical axis supply water to a circular area, sprinklers which oscillate about a horizontal axis serving a rectangular area are generally preferred because the entire lawn can be uniformly watered by successively sprinkling areas with straight common boundaries. To achieve improved certainty and continuity of operation and uniform watering for a given setting, horizontal oscillating sprinklers have become increasingly complex with concomitantly increasing cost and mechanical failure probability.

SUMMARY

An oscillating sprinkler is disclosed. The sprinkler has a drive motor coupled between an input port and an oscillating nozzle. The drive motor includes a flow adapter having a sun gear at one end and coupling to the input port at the other end. A gear assembly has a drive gear that is engaged with the sun gear of the flow adapter. A motor housing has a gear train chamber for the gear assembly, and a first chamber and a second chamber each providing for a path of flow. A switching mechanism has a valve block for alternatingly blocking and establishing the path of flow through one of the first chamber and the second chamber of the motor housing. A water wheel alternating in rotation between a clockwise direction and a counter clockwise direction based on the path of flow from one of the first chamber and the second chamber of the motor housing and engaging the gear assembly to rotate the gear assembly back and forth around the sun gear of the flow adapter and simultaneously moving the oscillating nozzle.

The switching mechanism further comprises a commutation yoke and a switch lever pivotally combined to the commutation yoke. The switch lever moves the commutation yoke into the valve block to alternatingly block and establish the path of flow through one of the first chamber and the second chamber of the motor housing. The switch lever pushes against one of the first stop and the second stop as the commutation yoke rotates in one of the clockwise and counter-clockwise direction and the force of the switch lever pushes the commutation yoke into engagement with the valve block with sufficient force to move the valve block to alternatingly block and establish the path of flow through one of the first chamber and the second chamber of the motor housing. The valve block has a first arm and a second arm each for blocking one of the first chamber and the second chamber of the motor housing, and the switching mechanism further comprises a first spring between the first arm of the valve block and the commutation yoke and a second spring between the second arm of the valve block and the commutation yoke.

DETAILED DESCRIPTION

Figure 1:
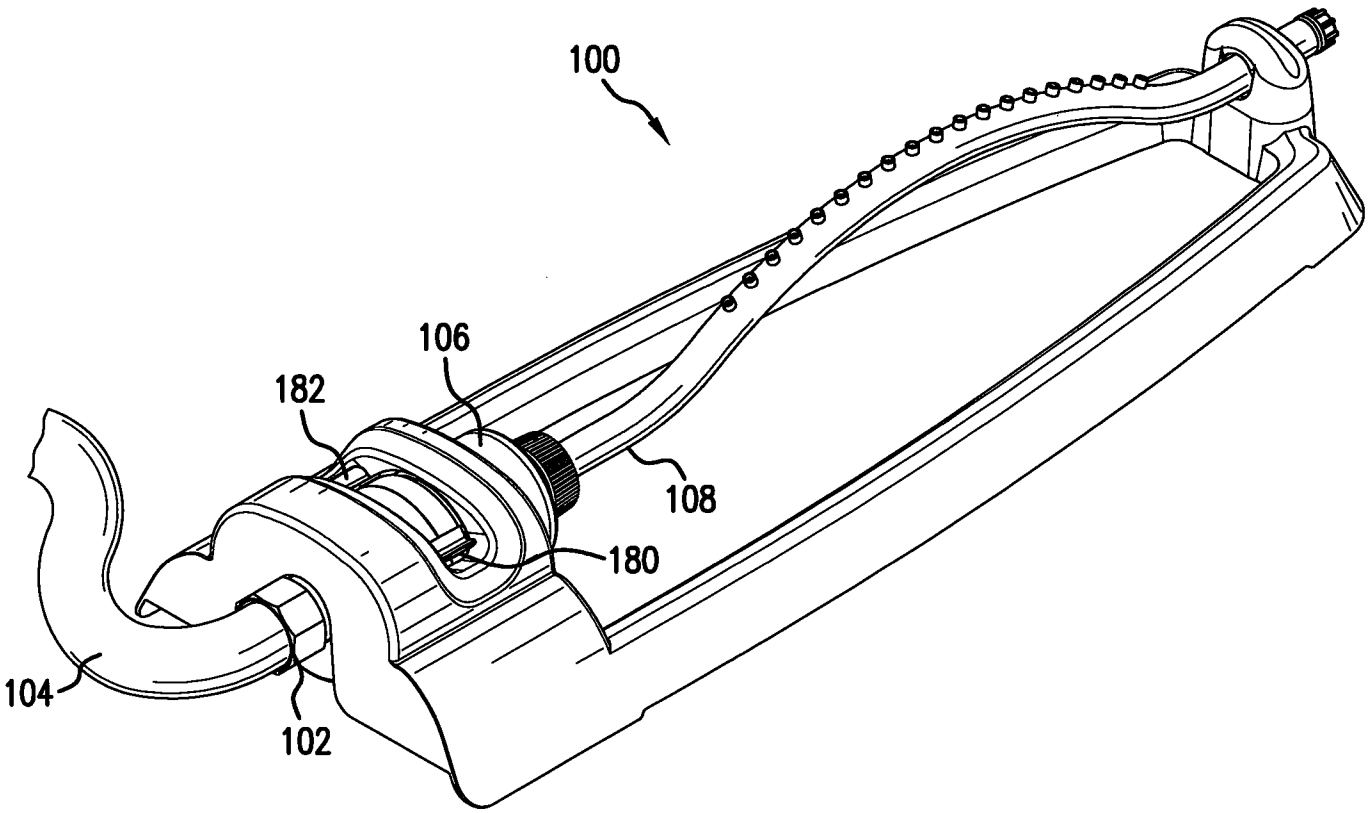
FIG. 1 is a perspective view of the sprinkler according to this disclosure.

FIG. 1 discloses a sprinkler 100 according to this disclosure. Sprinkler 100 includes an input port 102 connected between a hose 104, which extends to a water source, and a drive motor 106 that is configured for oscillating movement of nozzle 108.

Figure 2:
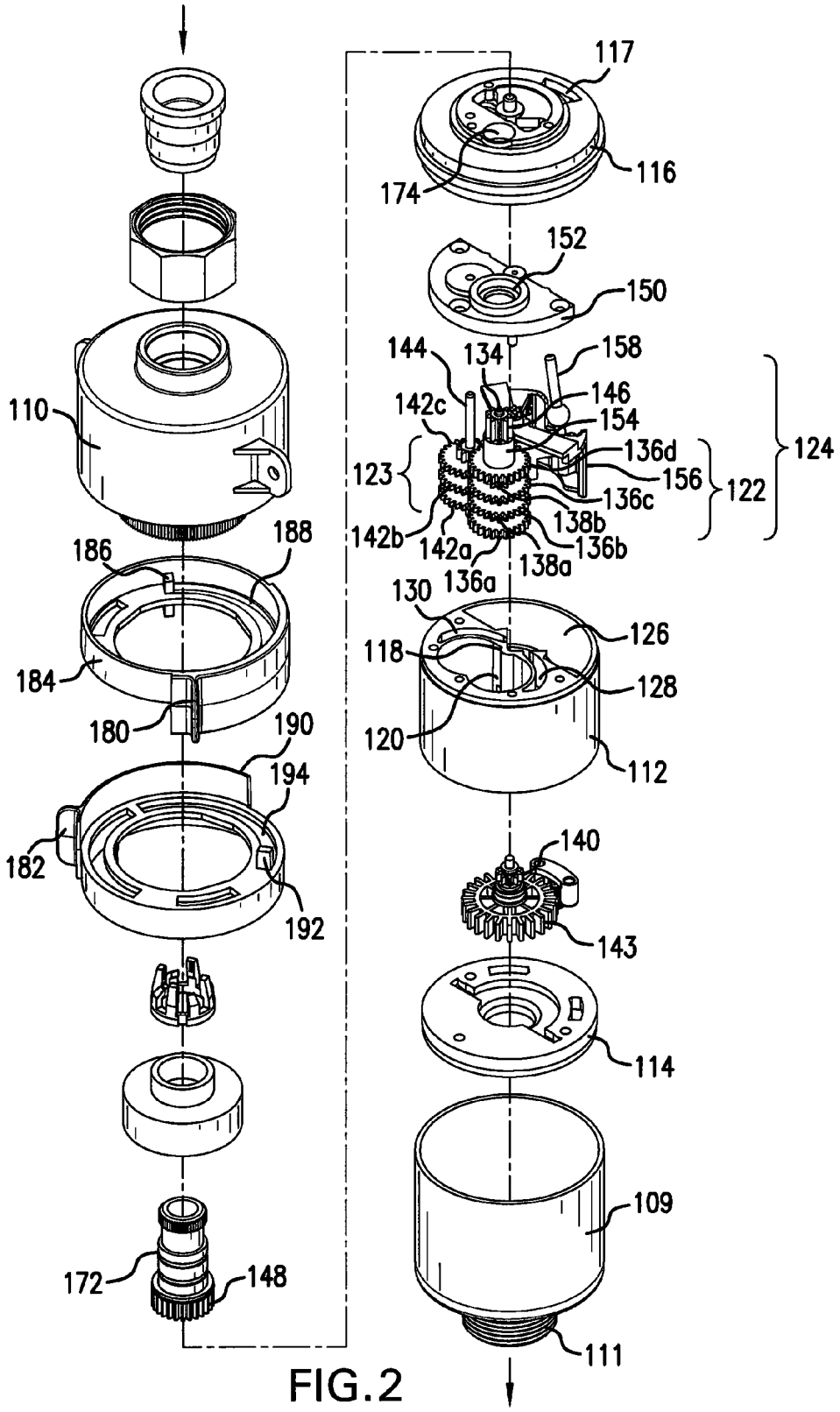
FIG. 2 is an exploded view of the motor drive unit.
Figure 3:
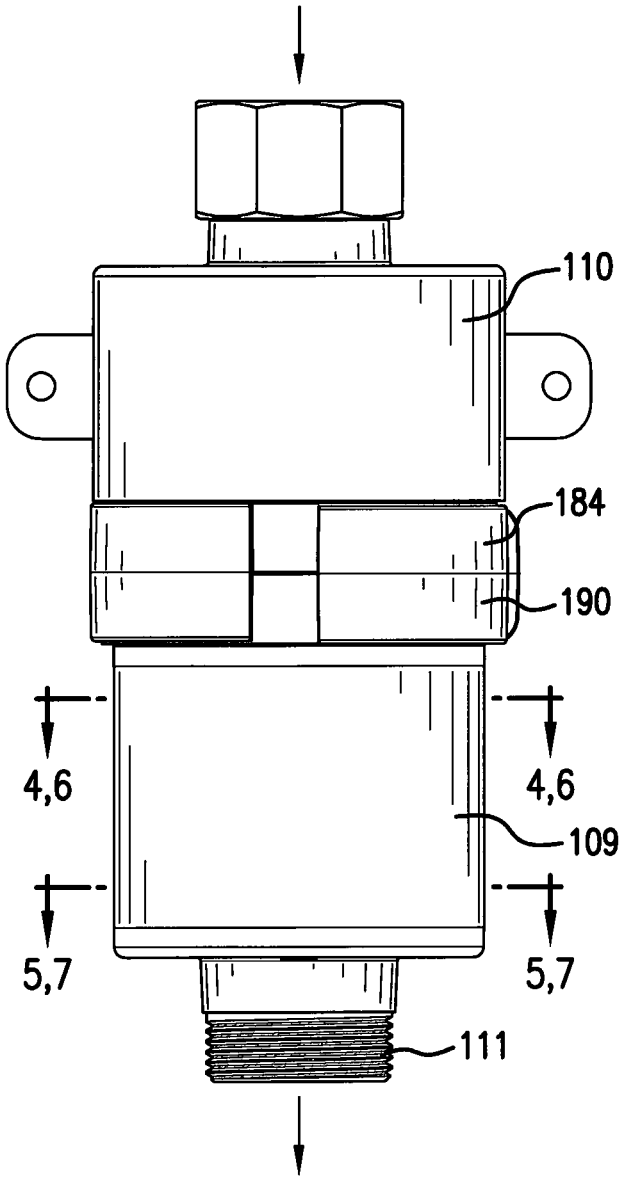
FIG. 3 is the motor drive unit.

FIG. 2 shows an exploded view of drive motor 106. Drive motor 106 is contained within a cylindrical housing having a lower end 109 and an upper end of cylinder housing 110. Lower end 109 of cylindrical housing is includes an exit port 111 for drive motor 106 that is connected to oscillating nozzle 108. Within lower end 109 is a motor housing 112 that is covered on opposite ends with a lower plate 114 and an upper plate 116.

Motor housing 112 has two sealed compartments that are separated by a sidewall 118 and two chambers 128 and 130 for providing a path of flow. The first compartment, a gear train chamber 120 receives a first gear assembly 122 and a second gear assembly 123 that cooperate to reduce an output of a drive gear 146 of first gear assembly 122, which rotates around a sun gear 148. The second compartment, a switch chamber 126 receives a switching mechanism 124. Switching mechanism 124 directs the flow of water through one of two chambers, chamber 128 and chamber 130, that correspond with clockwise and counter-clockwise rotation of a water wheel 143, respectively.

More specifically, first gear assembly 122 includes a shaft 134 to support a plurality of gears including, from bottom to top, alternating pinion gear 136*a*, spur gear 138*a*, pinion gear 136*b*, spur gear 138*b*, pinion gear 136*c*, spur gear 138*c*, and pinion gear 136*d*. Another pinion gear 140 that is coupled to water wheel 143 drives the bottom pinion gear 136*a* of first gear assembly 122, and the rest of pinion gears 136*b* and 136*c* and spur gears 138*a* and 138*b* on shaft 134.

Each spur gear 138*a*, 138*b*, and 138*c* in first gear assembly 122 engages a corresponding pinion gear 142*a*, 142*b*, and 144*c*, respectively, supported on a shaft 144 in second gear assembly 123. Near the top of shaft 134 of first gear assembly 122 is drive gear 146 that engages sun gear 148 on flow adapter 172. Drive gear 146 fits on a hub 154 around shaft 134 of first gear assembly 122. Gear train chamber 120 is closed at the top by cover 150 with drive gear 146 extending out of a sealed hole 152 of cover 150 and a hole 174 in upper plate 116 to engage sun gear 148 in flow adapter 172. This causes motor housing 112 to rotate back and forth around sun gear 148 with a frequency of oscillation.

Figure 9:
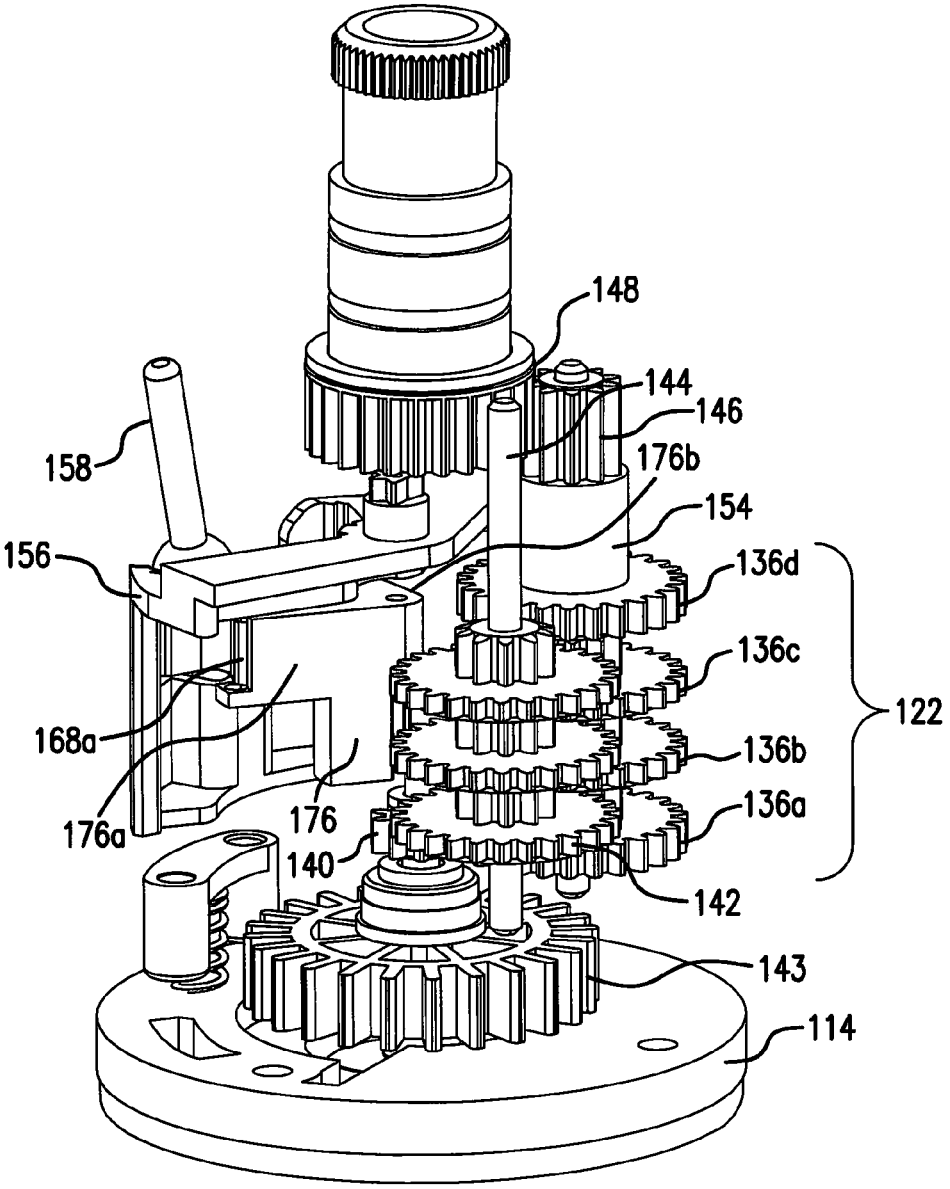
FIG. 9 shows an internal perspective view of the switching mechanism of the motor drive unit of FIG. 3 with the lever in a first position.
Figure 10:
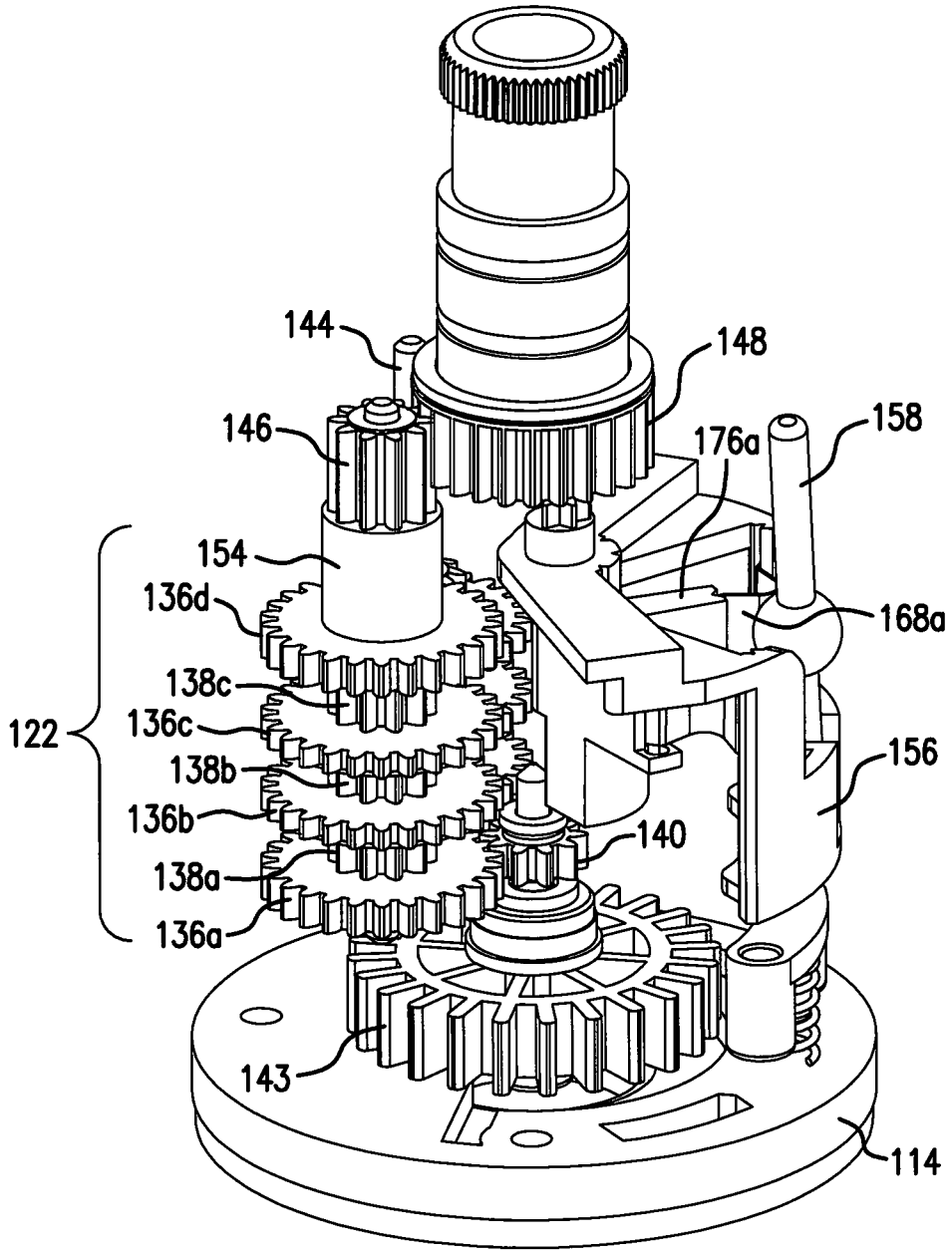
FIG. 10 shows an internal perspective view of the switching mechanism of the motor drive unit of FIG. 3 with the lever in a second position.

Positioned within switch chamber 126 is switching mechanism 124 which causes the oscillating rotation of nozzle 108. Switch mechanism 124 includes a commutation yoke 156, a valve block 176, and switch lever 158 (see FIG. 9). Commutation yoke 156 rotates with respect to valve block 176. Valve block 176 has a first arm 176*a* and a second arm 176*b*. Positioned between first arm 176*a* and commutation yoke 156 is a first spring 168*a* and positioned between second arm 176*b* and commutation yoke 156 is a second spring 168*b* to alternatively bias valve block 176 in position to close one of chamber 128 and chamber 130. First spring 168*a* and second spring 168*b* cause a quick, crisp snap action movement of valve block 176 to quickly close one of chamber 128 and chamber 130, that correspond with clockwise and counter-clockwise rotation of a water wheel 143, respectively.

Figure 4:
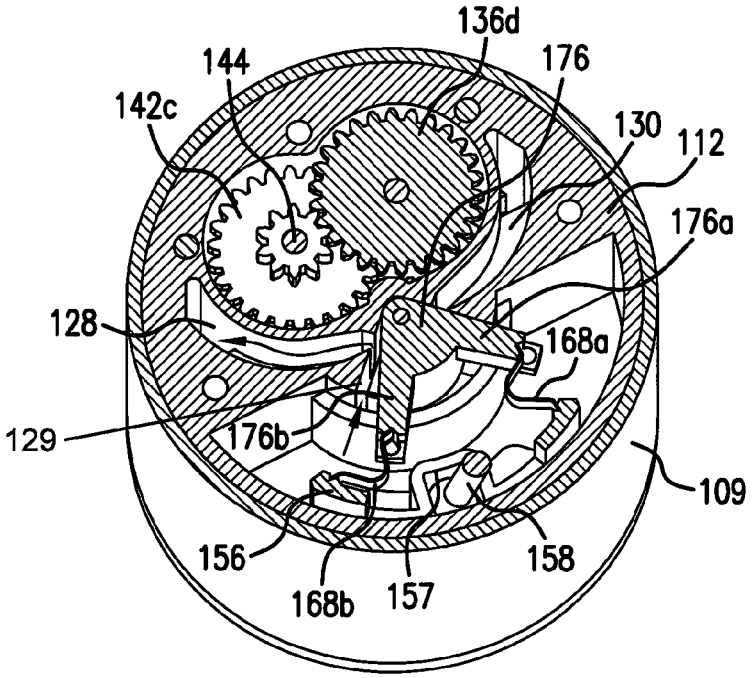
FIG. 4 is the motor drive unit taken along the line 4-4 of FIG. 3.
Figure 5:
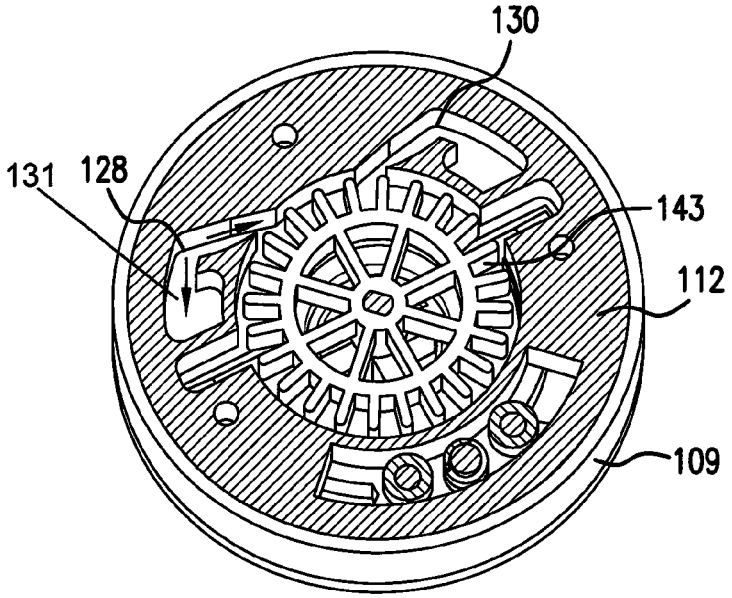
FIG. 5 is the motor drive unit taken along the line 5-5 of FIG. 3.

FIG. 4 shows water flowing in the direction of the arrows into an inlet 129 of chamber 128. FIG. 5 shows water flowing in the direction of the arrows out of an outlet 131 of chamber 128 to drive water wheel 143 in the clockwise direction. As discussed above, as water wheel 143 rotates in the clockwise direction, drive gear 146 similarly rotates, at a reduced speed, in a clockwise direction around sun gear 148. Commutation yoke 156 similarly rotates in synchronization with drive gear 146 in a clockwise direction until second spring 168*b* is moved over-center and snaps second arm 176*b* of valve block 176 into position blocking water flow into chamber 128 and opening chamber 130.

Figure 6:
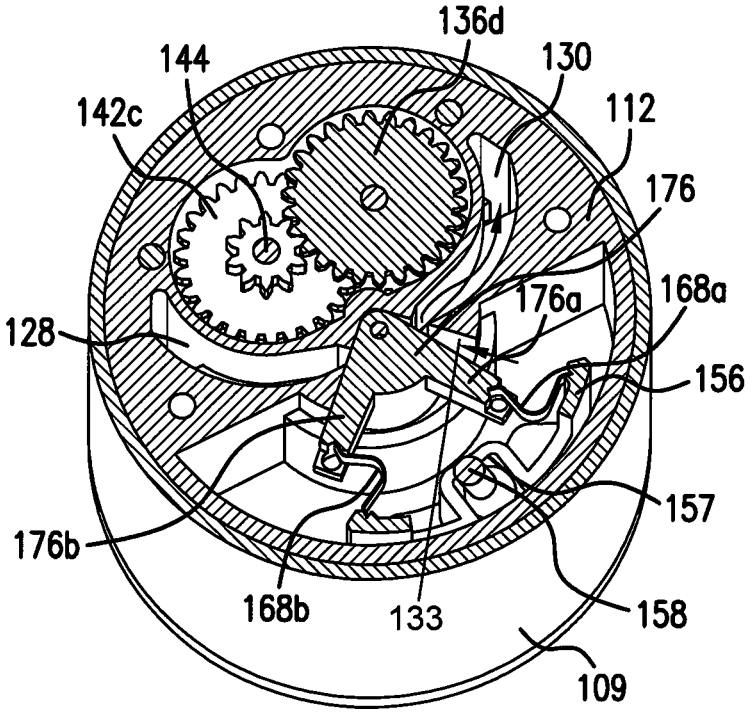
FIG. 6 is the motor drive unit taken along the line 6-6 of FIG. 3.
Figure 7:
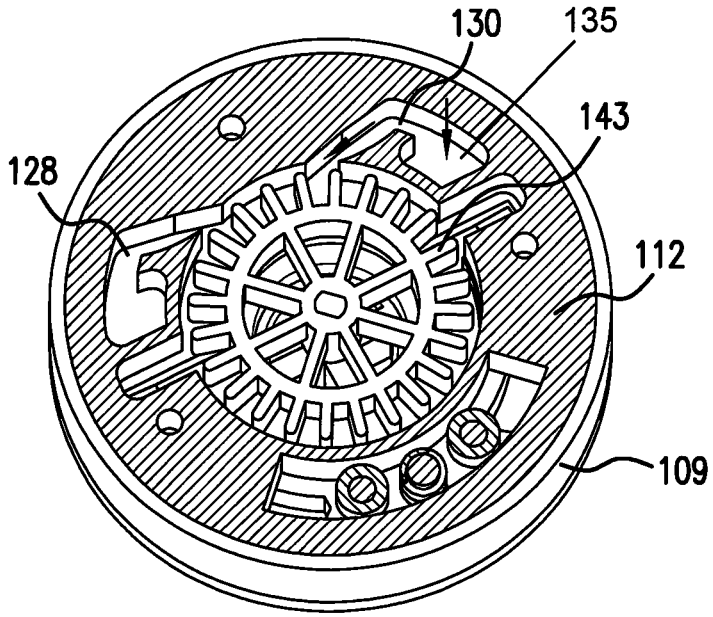
FIG. 7 is the motor drive unit taken along the line 7-7 of FIG. 3
Figure 8:
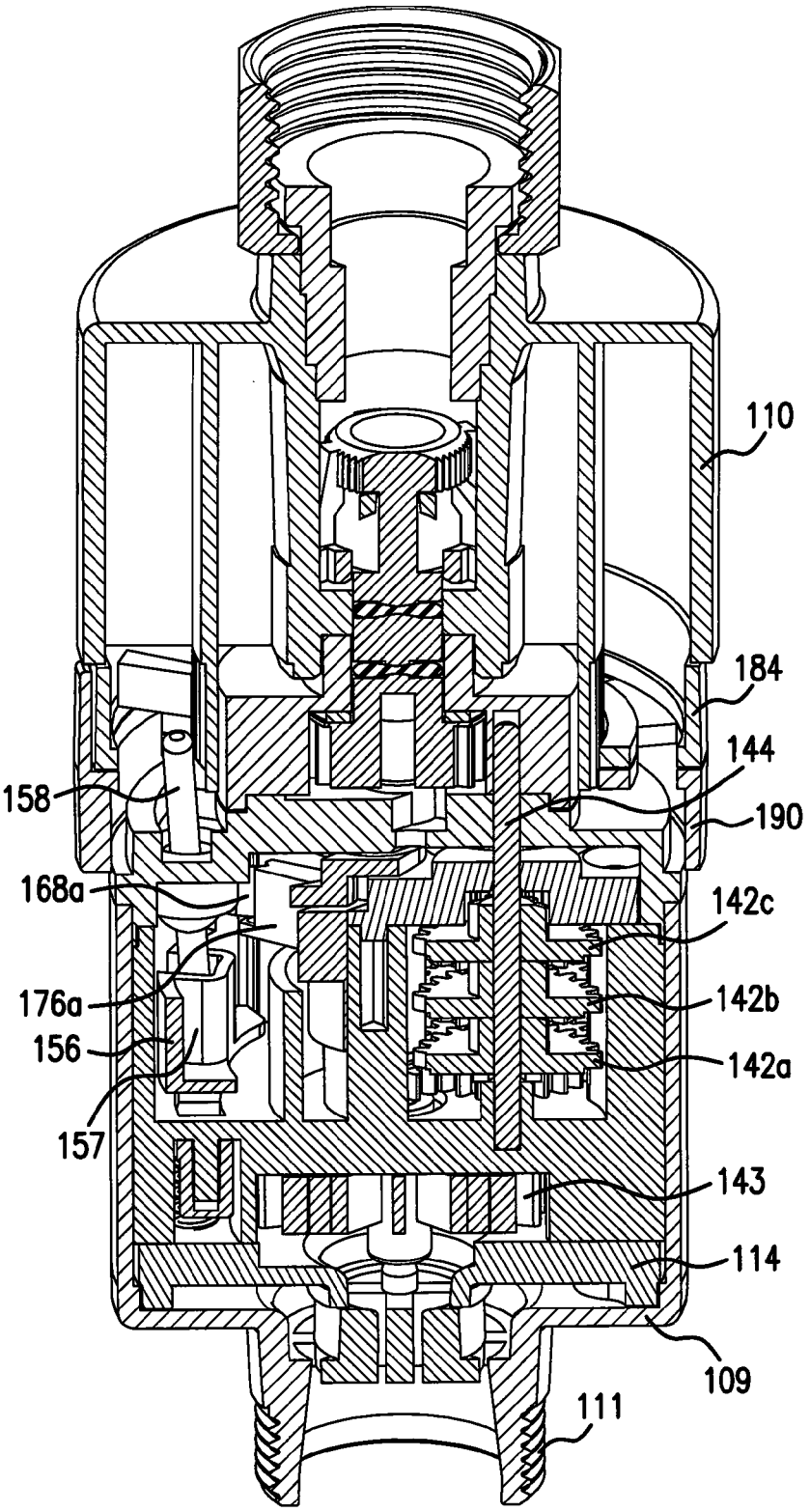
FIG. 8 is a cross-sectional view of the latitudinal cross section of the motor drive unit of FIG. 3.

FIG. 6 shows water flowing in the direction of the arrows into an inlet 133 of chamber 130. FIG. 7 shows water flowing in the direction of the arrows out of an outlet 135 of chamber 130 to drive water wheel 143 in the counter clockwise direction. As discussed above, as water wheel 143 rotates in the counter clockwise direction, drive gear 146 similarly rotates, at a reduced speed, in a counter clockwise direction around sun gear 148. Commutation yoke 156 similarly rotates in synchronization with drive gear 146 in a counter clockwise direction until first spring 168*a* is moved over-center and snaps first arm 176*a* of valve block 176 into position blocking water flow into chamber 130 and opening chamber 128.

The distance in the arc of travel for nozzle 108 is set by a first limit switch 180 and a second limit switch 182. First limit switch 180 is on a first spacer 184 that rotates with respect to the upper end of cylinder housing 110. Inside first spacer 184 is a first stop 186 at the end of a first arcuate path 188. Second limit switch 182 is on a second spacer 190 that rotates with respect to upper end of cylinder housing 110. Inside second spacer 190 is a second stop 192 at the end of a second arcuate path 194. First spacer 184 and second spacer 190 rotate with respect to each other so that with first limit switch 180 and second limit switch 184 at the farthest distance from each other first arcuate path 188 and second arcuate path are aligned with each other and first stop 186 and second stop 192 are at the maximum distance apart. This position will allow nozzle 108 to rotate back and forth in the longest path of travel and highest frequency of oscillation. As first limit switch 180 and/or second limit switch 182 are moved with respect to each other, first arcuate path 188 and second arcuate path are moved with respect to each other so that the aligned open space between them is smaller and the distance between first stop 186 and second stop 192 is decreased along with the frequency of oscillation. The movement of first limit switch 180 and/or second limit switch 182 changes the distance that nozzle 108 will travel back and forth.

Figure 11:
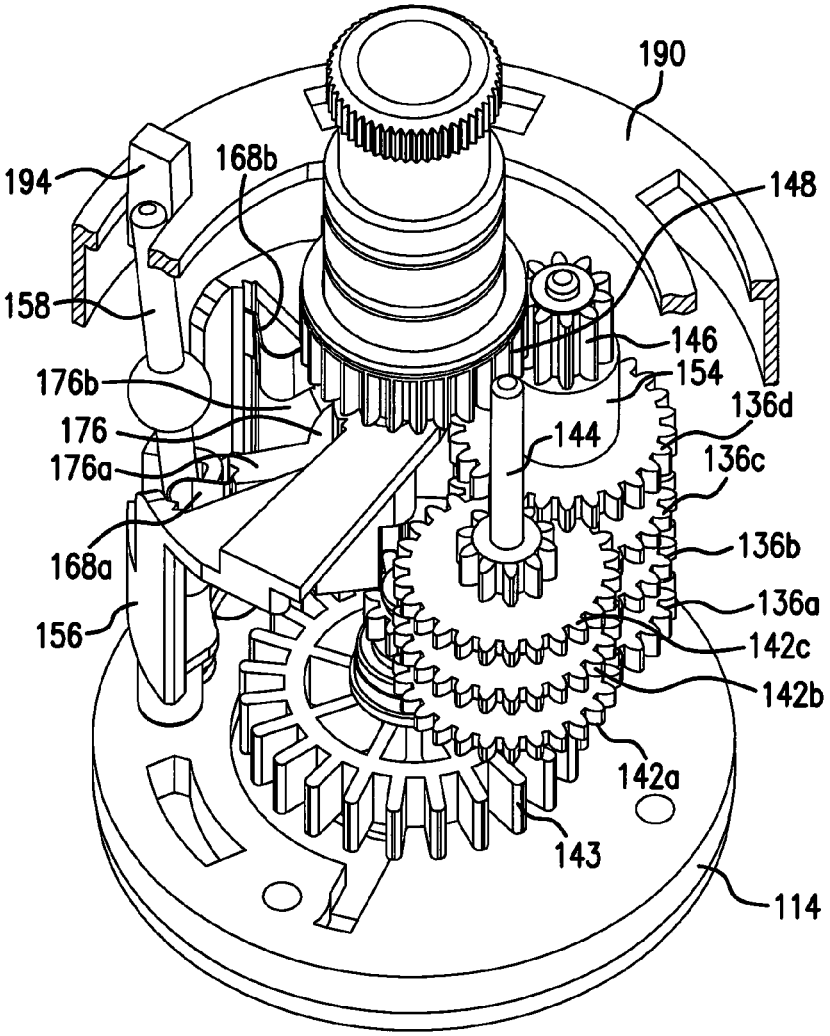
FIG. 11 shows another internal perspective view of the switching mechanism of the motor drive unit of FIG. 3 with the lever in the first position.

Switch lever 158 is positioned with its fulcrum in a catch 157 near the bottom end of commutation yoke 156. The upper end of switch lever 158 projects out of a hole 117 in upper plate 116 where it alternatively pushes against one of first stop 186 in first spacer 184 and second stop 192 in second spacer 190 corresponding with a first extent and a second extent for oscillation. Turning to FIG. 11, as commutation yoke 156 rotates clockwise, the upper end of switch lever 158 buts up against second stop 192 on second spacer 190, so that it is no longer able to move. Commutation yoke 156 continues rotating in the clockwise direction bringing the bottom, fulcrum of switch lever 158 with it until the force against second arm 176*b* of valve block 176 is sufficient to overcome second spring 168*b* and second spring 168*b* is moved over-center and snaps second arm 176*b* of valve block 176 into position blocking water flow into chamber 128 and opening chamber 130.

Figure 12:
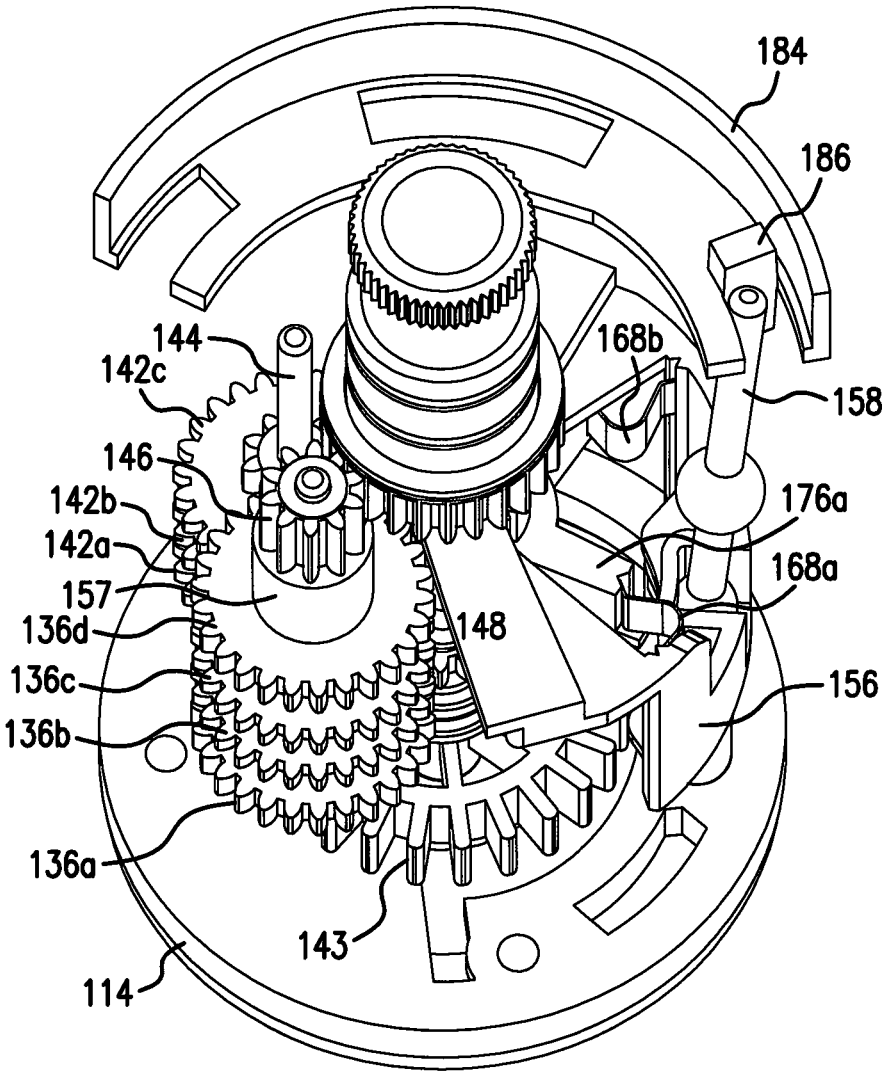
FIG. 12 shows another internal perspective view of the switching mechanism of the motor drive unit of FIG. 3 with the lever in the second position.

Turning to FIG. 12, as commutation yoke 156 rotates counter clockwise, the upper end of switch lever 158 buts up against first stop 186 on first spacer 184, so that it is no longer able to move. Commutation yoke 156 continues rotating in the counter clockwise direction bringing the bottom fulcrum of switch lever 158 with it until the force against first arm 176*a* of valve block 176 is sufficient to overcome first spring 168*a* and first spring 168*a* is move over-center and snaps first arm 176*a* of valve block 176 into position blocking water flow into chamber 130 and opening chamber 128.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. An oscillating sprinkler comprising:

a housing having a first chamber and a second chamber each providing a path of flow;

a water wheel rotating in a clockwise direction and a counter clockwise direction depending on the flow;

a switching mechanism for changing the flow between the first chamber and the second chamber, wherein the switching mechanism further comprises of: (i) a valve block with a first arm and a second arm that alternates between closing the path of flow to the second chamber of the housing with the second arm while simultaneously opening the path of flow to the first chamber of the housing to rotate the water wheel in the clockwise direction, and closing the path of flow to the first chamber of the housing with the first arm while simultaneously opening the path of flow to the second chamber of the housing to rotate the water wheel in the counter-clockwise direction, and (ii) a commutation yoke that rotates with respect to the valve block in a clockwise direction when the water wheel rotates in a clockwise direction and rotates in a counter-clockwise direction when the water wheel rotates in a counter-clockwise direction; and (iii) a first spring between the first arm of the valve block and the commutation yoke, and a second spring between the second arm of the valve block and the commutation yoke, wherein the commutation yoke rotates in the clockwise direction until the second spring is moved over-center and snaps the second arm of the valve block into position closing the path of flow to the second chamber of the housing, and wherein the commutation yoke rotates in the counter-clockwise direction until the first spring is moved over-center and snaps the first arm of the valve block into position closing the path of flow to the first chamber of the housing;

wherein the first chamber of the housing has an entrance port at a top of the housing that surrounds a gear assembly and has an exit port on one side of the water wheel to rotate the water wheel in the clockwise direction and the second chamber of the housing has an entrance port at a top of the housing that surrounds the gear assembly and has an exit port on the other side of the water wheel to rotate the water wheel in the counter clockwise direction;

a first gear assembly comprising a plurality of alternating pinion gears and spur gears each driven by the water wheel and a second gear assembly comprising a plurality of pinion gears each engaged by a corresponding pinion gear of the first gear assembly to reduce a speed of rotation of the switching mechanism between a first extent and a second extent; and a first stop selectively moveable to a first position corresponding with the first extent and a second stop selectively moveable to a second position corresponding to the second extent, wherein the switching mechanism further comprises a lever that moves between the first stop and the second stop wherein the lever has a fulcrum positioned in a catch combined to the commutation yoke so that the lever rotates with the commutation yoke.

2. An oscillating sprinkler having a drive motor coupled between an input port and an oscillating nozzle, the oscillating sprinkler comprising:

a flow adapter coupled to the input port providing a path of flow from the input port;

a housing having a first chamber and a second chamber;

a water wheel alternating in rotation between a clockwise direction and a counter clockwise direction based on the path of flow from one of the first chamber and the second chamber and simultaneously moving the oscillating nozzle; and a switching mechanism comprising (i) a valve block for alternatingly blocking and establishing the path of flow through one of the first chamber and the second chamber of the housing, the valve block further comprising a first arm and a second arm that alternates between closing the path of flow to the second chamber of the housing with the second arm while simultaneously opening the path of flow to the first chamber of the housing to rotate the water wheel in the clockwise direction, and closing the path of flow to the first chamber of the housing with the first arm while simultaneously opening the path of flow to the second chamber of the housing to rotate the water wheel in the counter-clockwise direction, (ii) a commutation yoke that rotates with respect to the valve block in a clockwise direction when the water wheel rotates in a clockwise direction and rotates in a counter-clockwise direction when the water wheel rotates in a counter-clockwise direction, (iii) a first spring between the first arm of the valve block and the commutation yoke, and a second spring between the second arm of the valve block and the commutation yoke, wherein the commutation yoke rotates in the clockwise direction until the second spring is moved over-center and snaps the second arm of the valve block into position closing the path of flow to the second chamber of the housing, and wherein the commutation yoke rotates in the counter-clockwise direction until the first spring is moved over-center and snaps the first arm of the valve block into position closing the path of flow to the first chamber of the housing, and (iv) a switch lever having a fulcrum engaged with a commutation yoke to rotate with the commutation yoke.

3. The oscillating sprinkler of claim 2, and further comprising a first gear assembly comprising a plurality of alternating pinion gears and spur gears each driven by the water wheel and a second gear assembly comprising a plurality of pinion gears each engaged by a corresponding pinion gear of the first gear assembly for moving the housing back and forth around the flow adapter.

4. The oscillating sprinkler of claim 3, wherein the commutation yoke and the valve block are axially aligned and the commutation yoke carries the switch lever and rotates with respect to the valve block.

5. The oscillating sprinkler of claim 3, and further comprising a first spacer coaxial with a second spacer for relative movement with respect to each other and each of the first spacer and the second spacer having an arcuate path, wherein the switch lever projects into the arcuate path and the switch lever's movement in the arcuate path is dependent upon the relative position of the first spacer with respect to the second spacer and the switch lever's movement in the arcuate path correlates with a frequency of oscillation of the oscillating nozzle.

6. The oscillating sprinkler of claim 5, wherein the first spacer comprises a first stop and the second spacer comprises a second stop wherein a distance between the first stop and the second stop is based on the relative position of the first spacer with respect to the second spacer.

* * * * *